United States Patent [19]

Ritchie et al.

[11] Patent Number: 4,530,755

[45] Date of Patent: Jul. 23, 1985

[54] COKING WITH SOLVENT SEPARATION OF RECYCLE OIL USING COKER NAPHTHA

[75] Inventors: Joseph M. Ritchie, Morristown; Bong H. Chang, Summit; John Sosnowski, Westfield, all of N.J.

[73] Assignee: Exxon Research and Engineering Co., Florham Park, N.J.

[21] Appl. No.: 547,086

[22] Filed: Oct. 31, 1983

[51] Int. Cl.[3] ..... C10G 21/06; C10G 55/04

[52] U.S. Cl. ..... 208/96; 208/85; 208/127; 208/131

[58] Field of Search ..... 208/127, 131, 96, 45, 208/307, 311, 81

[56] References Cited

U.S. PATENT DOCUMENTS

| | | | |
|---|---|---|---|
| 2,696,458 | 12/1954 | Strickland | 208/96 |
| 2,727,853 | 12/1955 | Hennig . | |
| 2,734,852 | 2/1956 | Moser, Jr. . | |
| 2,742,518 | 4/1956 | Mattox . | |
| 2,777,802 | 1/1957 | Peet . | |
| 2,901,413 | 8/1959 | Newchurch et al. . | |
| 2,905,617 | 9/1959 | Jahing et al. | 208/127 |
| 2,947,681 | 8/1960 | Read et al. | 208/86 |
| 3,247,095 | 4/1966 | Conwell | 208/95 |
| 3,661,543 | 5/1972 | Saxton . | |
| 4,057,487 | 11/1977 | Metrailer et al. . | |
| 4,354,928 | 10/1982 | Audeh . | |
| 4,435,276 | 3/1984 | Matsumiya et al. | 208/106 |

*Primary Examiner*—D. E. Gantz
*Assistant Examiner*—Anthony McFarlane
*Attorney, Agent, or Firm*—Marthe L. Gibbons

[57] ABSTRACT

A coking process is provided in which a stream of heavy oil product, which typically is recycled to the coking zone, is first subjected to solvent separation using coker naphtha as solvent to separate the heavy oil into a high Conradson carbon content product comprising a minor portion of the coker naphtha and a lower Conradson carbon content product comprising a major portion of the coker naphtha and, thereafter, recovering the lower Conradson carbon content product and recycling the high Conradson content product, including the minor portion of coker naphtha, to the coking zone.

13 Claims, 1 Drawing Figure

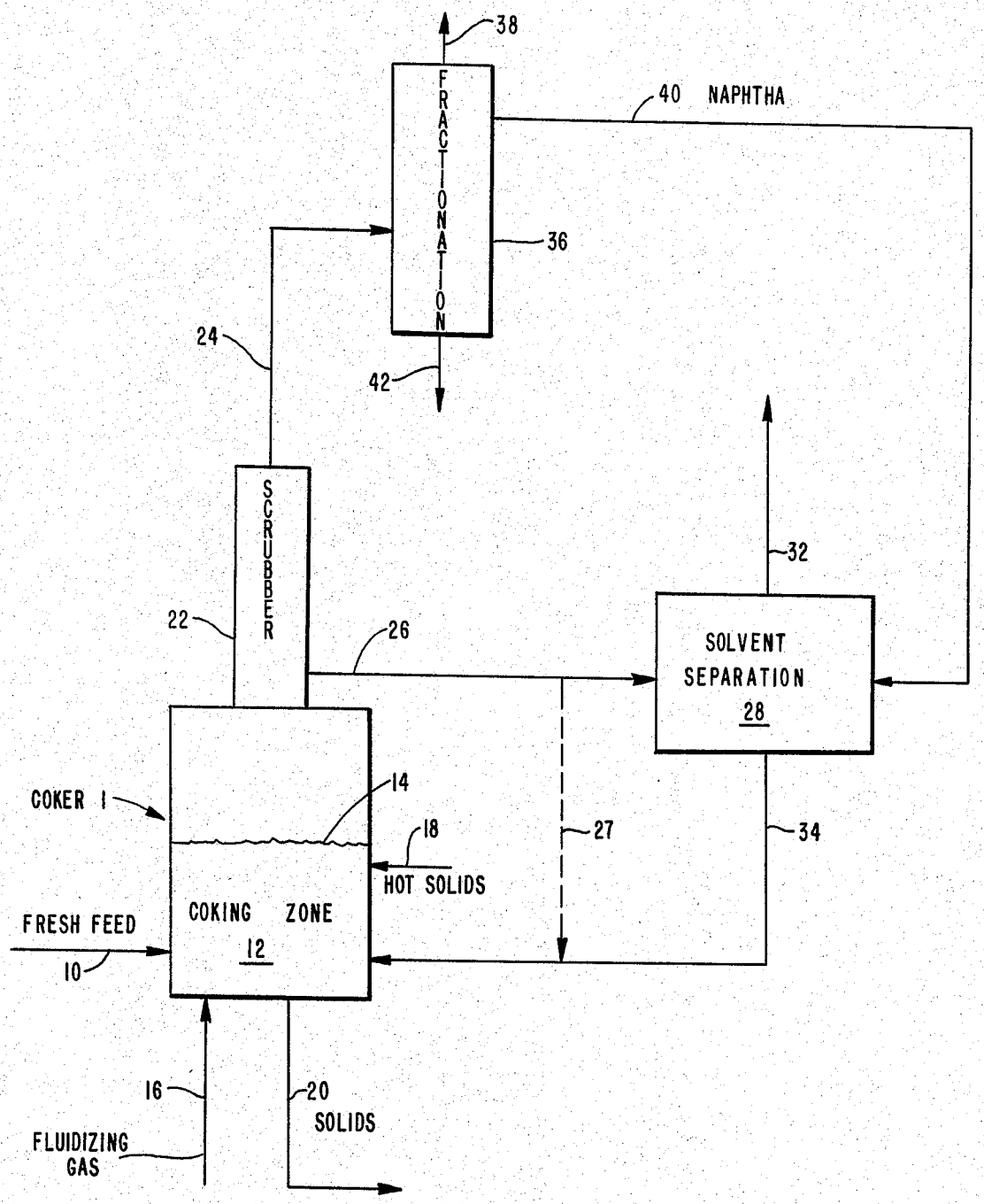
38
FRACTIONATION
40 NAPHTHA
36
24
42
SCRUBBER
32
22
26
SOLVENT SEPARATION
28
COKER 1
14
18
27
34
HOT SOLIDS
FRESH FEED
COKING ZONE
12
10
16
20
SOLIDS
FLUIDIZING GAS

COKING WITH SOLVENT SEPARATION OF RECYCLE OIL USING COKER NAPHTHA

BACKGROUND OF THE INVENTION

1. Field of the Invention

The present invention relates to an improvement in a coking process.

2. Description of the Prior Art

Fluid coking is a well-known process. See, for example, U.S. Pat. No. 2,881,130, the teachings of which are hereby incorporated by reference. The fluid coking process can be conducted with or without recycle of the heavy constituents of the coking product. Integrated fluid coking and coke gasification processes are also known and disclosed, for example, in U.S. Pat. Nos. 3,702,516; 3,759,676; and 4,325,815, the teachings of which are hereby incorporated by reference.

Delayed coking is a well-known process in which a hydrocarbonaceous oil is heated to a coking temperature and then passed into a coking drum to produce a vapor phase product, including liquid hydrocarbons and coke. See *Hydrocarbon Processing*, September 1980, page 153.

The present invention is applicable to conventional fluid coking processes as well as to integrated fluid coking and gasification processes and to delayed coking.

U.S. Pat. No. 4,057,487 discloses a fluid coking process in which the heavy oil stream separated from the coker products in a scrubbing zone is passed to a vacuum distillation zone and a vacuum distillation zone bottoms fraction is recycled to the coking zone.

U.S. Pat. No. 2,777,802 discloses, in FIG. 2, a fluid coking process in which the total coker overhead product is subjected to extractive distillation to remove metal contaminants. A bottoms product from the extractive distillation zone may be recycled to the coking zone.

It is known to recycle coker-derived naphtha to the coking zone. See, for example, U.S. Pat. No. 2,734,852; U.S. Pat. No. 2,742,518.

U.S. Pat. No. 4,354,928 discloses deasphalting hydrocarbon oils utilizing a solvent which may be a coker naphtha (see column 2, line 48).

SUMMARY OF THE INVENTION

In accordance with the invention, there is provided a coking process comprising the steps of:

(a) coking a carbonaceous chargestock in a coking zone at coking conditions to produce coke and a vapor phase product, including heavy and light normally liquid hydrocarbons;

(b) separating at least a portion of said heavy hydrocarbons from said vapor phase product;

(c) subsequently contacting at least a portion of said separated heavy hydrocarbons with coker naphtha in a solvent separation zone at solvent separation conditions to separate said heavy hydrocarbons into a high Conradson carbon hydrocarbonaceous product comprising a minor portion of said coker naphtha and a low Conradson carbon hydrocarbonaceous product comprising a major portion of said coker naphtha, and (d) recycling at least a portion of said high Conradson carbon hydrocarbonaceous product comprising said coker naphtha to said coking zone.

By the expression "Conradson carbon content" with reference to an oil is intended herein the residue that would be obtained when the given oil is subjected to ASTM test D-189-65.

BRIEF DESCRIPTION OF THE DRAWING

The FIGURE is a schematic flow plan of one embodiment of the invention.

DESCRIPTION OF THE PREFERRED EMBODIMENT

Although solvent separation of the coker product recycle oil stream is applicable to the recycle oil stream of a delayed coking process as well as to the recycle oil stream of a fluid coking process, the preferred embodiment will be described with reference to the fluid coking process of the accompanied FIGURE.

Referring to the FIGURE, a carbonaceous material is passed by line 10 into coking zone 12 in which is maintained a fluidized bed of solids (e.g., coke particles of 40 to 1000 microns in size) having an upper level indicated at 14. Carbonaceous feeds suitable for the coking zone of the present invention include heavy hydrocarbonaceous oils; heavy and reduced petroleum crude; petroleum atmospheric distillation bottoms; petroleum vacuum distillation bottoms; pitch, asphalt, bitumen, other heavy hydrocarbon residues; tar sand oil; shale oil; coal; coal slurries; liquid products derived from coal liquefaction processes, including coal liquefaction bottoms, and mixtures thereof. Typically, such feeds have a Conradson carbon content of at least about 5 weight percent, generally from about 5 to about 50 weight percent, preferably above 7 weight percent (as to Conradson carbn residue, see ASTM test D 189-65). A fluidizing gas, e.g., steam, is admitted at the base of coker 1 through line 16 in an amount sufficient to obtain superficial fluidizing gas velocities in the range of 0.5 to 5 feet per second. The fluidizing gas may comprise steam, vaporized normally liquid hydrocarbons, normally gaseous hydrocarbons, hydrogen, hydrogen sulfide, and mixtures thereof. Typically, the fluidizing gas will comprise steam. Solids at a temperature above the coking temperature, for example, from 100 to 1000 Fahrenheit degrees above the actual operating temperature of the coking zone, are admitted to coker 1 by line 18 in an amount sufficient to maintain the coking temperature in the range of about 850° to about 1800° F. For the production of fuels, the coking temperature will range preferably from about 850° to about 1200° F., more preferably, from about 900° to about 1200° F., whereas for the production of chemicals, the temperature will preferably range from about 1200° to about 1800° F. The pressure in the coking zone is maintained in the range of about 0 to about 150 pounds per square inch gage (psig), preferably in the range of about 5 to about 45 psig. The lower portion of the coker serves as stripping zone to remove occluded hydrocarbons from the solids. A stream of solids is withdrawn from coker 1 by line 20 for passage to a coke burner, a coke heater or a coke gasifier wherein the coke is heated and recirculated to the coker. In coking zone 12, the carbonaceous feed introduced into the coker is cracked by contact with the hot fluidized solids to coke, which deposits on the solids, and to a vaporous product, including heavy and light normally liquid hydrocarbons.

The vaporous coker product, which includes normally liquid hydrocarbons and gases, flows upwardly into scrubbing zone 22 wherein the heavier constituents of the vapor phase coker product are separated by condensation. The remaining coker vapor phase product, which includes the light normally liquid hydrocarbons, is removed overhead from scrubbing zone 22 and passed by line 24 to fractionation zone 36 which could be superimposed on the scrubbing zone. In fractionation zone 36, the coker vaporous product is separated into a gas removed by line 38, an intermediate boiling fraction (e.g., gas oil) removed by line 42 and a coker naphtha fraction removed by line 40. The term "coker naphtha" is used herein to connote a mixture of hydrocarbons boiling in the range of about $C_5$° to 430° F., preferably from about $C_5$° to 350° F., at atmospheric pressure and derived from a coking process. Coker naphtha typically comprises a large amount of unsaturated hydrocarbons, typically from 10 to 70 volume percent olefins and from 1 to 20 volume percent diolefins, and has a bromine number ranging from 40 to 140 (ASTM method). At least a portion of the coker naphtha of line 40 is passed to solvent separation zone 28 as solvent. It should be noted that the coker naphtha to be used in solvent separation zone 28 could be derived from another coking unit or from previous runs. In the preferred embodiment, the coker naphtha is a recycled stream obtained from the process. The bottoms fraction of scrubbing zone 22, which comprises the condensed heavy portion of the vaporous coker product including asphaltenes, is withdrawn from scrubbing zone 22 by line 26 and at least a portion, preferably all, is passed to solvent separation zone 28. If desired, a portion of the bottoms fraction may be recycled to the coking zone by line 27. The initial atmospheric pressure boiling point of the bottoms fraction of the scrubber will generally range from about 650° F. to about 1100° F.

The Conradson carbon content of the bottoms fraction of the scrubber, which is passed to the solvent separation zone, will generally range from about 5 to about 50 weight percent. In solvent separation zone 28, the coker naphtha solvent contacts the bottoms fraction of the scrubber. Suitable volumetric ratios of solvent to bottoms fraction will generally range from about 0.5:1 to 10:1, preferably 1:1 to 6:1.

The solvent contacting step is conducted at conditions and for a time sufficient to separate the bottoms fraction of the scrubber into a high Conradson carbon content hydrocarbonaceous product stream and a lower Conradson carbon hydrocarbonaceous stream. The Conradson carbon content of the low Conradson carbon stream will be less than that of the bottoms fraction of the scrubber which is passed to the solvent separation zone. The Conradson carbon content of the high Conradson carbon stream will be greater than the Conradson carbon content of the bottoms fraction of the scrubber that is passed to the solvent separation zone. Suitable conditions for solvent separation with coker naphtha include a temperature ranging from about 170° to about 700° F., preferably from 250° to 450° F., a pressure ranging from 50 to 1500 psig, preferably from 200 to 500 psig, and a time period ranging from 5 minutes to 2 hours.

The high Conradson carbon content stream comprises the asphaltenes that were present in bottoms fraction of the scrubber that was subjected to solvent separation and a minor portion of the coker naphtha that was used to contact the bottoms fraction of the scrubber. The low Conradson content stream comprises a major portion of the coker naphtha that was used as solvent in the separation zone. The high Conradson carbon stream, including the minor portion of coker naphtha, is withdrawn from solvent separation zone 28 and recycled by line 34 to coking zone 12. The amount of recycle is not critical. The coker naphtha in stream 34 serves as a flux to reduce the viscosity of the stream and makes the stream easier to pump. Furthermore, the coker naphtha recycled to coking zone 12 via line 34 serves as additional fluidizing gas and, thereby, permits using less steam or other gas as fluidizing gas. By "minor portion" with reference to the coker naphtha is intended herein less than about 50 volume percent of the coker naphtha that is introduced into the solvent separation zone.

The low Conradson carbon content stream comprising the major portion of the coker naphtha used in separation zone 28 is removed from solvent separation zone 28 by line 32. This stream may be sent to further treating such as hydrorefining or catalytic cracking processes without the necessity of removing the coker naphtha that may be entrained in this stream. Alternatively, the coker naphtha may be recovered from stream 32. By "major portion" with reference to the coker naphtha is intended herein at least 50 volume percent of the coker naphtha introduced into the solvent separation zone.

The use of coker naphtha as solvent in the solvent separation of the coker recycle oil minimizes the need to recover the solvent from the high Conradson carbon content stream that is recycled to the coker.

What is claimed is:

1. A coking process comprising the steps of:

(a) coking a carbonaceous chargestock in a coking stock at coking conditions to produce coke and a vapor phase product, including heavy and light normally liquid hydrocarbons;

(b) separating at least a portion of said heavy hydrocarbons from said vapor phase product, said separated hydrocarbons having a Conradson carbon content ranging from about 5 to about 50 weight percent;

(c) subsequently contacting at least a portion of said separated heavy hydrocarbons with coker naphtha in a solvent separation zone at solvent separation conditions, including a volumetric ratio of said solvent to said portion of separated heavy hydrocarbon ranging from about 0.5:1 to 10:1, to separate said heavy hydrocarbons into a high Conradson carbon hydrocarbonaceous product comprising a minor portion of said coker naphtha and a low Conradson carbon hydrocarbonaceous product comprising a major portion of said coker naphtha;

(d) recycling at least a portion of said high Conradson carbon hydrocarbonaceous product comprising said minor portion of coker naphtha to said coking zone; and (e) recovering said low Conradson carbn hydrocarbonaceous product of step (c).

2. The process of claim 1 wherein a naphtha fraction is separated from said vapor phase product of step (a) and wherein at least a portion of said separated naphtha fraction is passed to said solvent separation zone of step (c).

3. The process of claim 1 wherein said coking process is a fluid coking process wherein said carbonaceous chargestock is contacted with hot fluidized solids in a fluidized bed contained in said coking zone.

4. The process of claim 3 wherein the initial atmospheric pressure boiling point of said heavy hydrocarbons separated from said vapor phase product ranges from about 650° to about 1100° F.

5. The process of claim 3 wherein said vapor phase product of step (a) is passed to a scrubbing zone, and wherein said heavy hydrocarbons of step (b) are separated in said scrubbing zone and said separated heavy hydrocarbons are withdrawn from said scrubbing zone and passed to said solvent separation zone.

6. The process of claim 1 wherein said carbonaceous chargestock comprises a hydrocarbonaceous oil having a Conradson carbon content of at least about 5 weight percent.

7. The process of claim 3 wherein said coking conditions include a temperature ranging from about 850° to about 1800° F. and a pressure ranging from about 0 to about 150 psig.

8. The process of claim 3 wherein said coking conditions include a temperature ranging from about 900° to about 1200° F.

9. The process of claim 1 wherein said coking process is delayed coking.

10. The process of claim 1 wherein said solvent separation conditions include a temperature ranging from about 170° F. to about 700° F.

11. The process of claim 1, wherein said solvent separation conditions include a pressure ranging from about 50 to 1500 psig.

12. A fluid coking process comprising the steps of:

(a) contacting a carbonaceous chargestock with hot fluidized solids in a fluidized bed contained in a coking zone at coking conditions to produce coke which deposits on said fluidized solids and a vapor phase product, including heavy and light normally liquid hydrocarbons;

(b) passing said vapor phase product of step (a) to a scrubbing zone and separating at least a portion of said heavy hydrocarbons from said vapor phase product in said scrubbing zone, said separated hydrocarbons having a Conradson carbon content ranging from 5 to 50 weight percent;

(c) subsequently contacting at least a portion of said separated heavy hydrocarbons with coker naphtha in a solvent separation zone at solvent separation conditions, including a volumetric ratio of said solvent to said portion of separated heavy hydrocarbons ranging from about 0.5:1 to 10:1, to separate said heavy hydrocarbons into a high Conradson carbon hydrocarbonaceous product comprising a minor portion of said coker naphtha and a low Conradson carbon hydrocarbonaceous product comprising a major portion of said coker naphtha;

(d) recycling at least a portion of said high Conradson carbon hydrocarbonaceous product comprising said minor portion of coker naphtha to said coking zone, and (e) recovering said low Conradson carbon hydrocarbonaceous product.

13. The process of claim 12 wherein said coker naphtha has a boiling point ranging from about C5° to about 350° F.

* * * * *